US005706599A

United States Patent [19]

Knight

[11] Patent Number: 5,706,599

[45] Date of Patent: Jan. 13, 1998

[54] RIFLE WITH INTERCHANGEABLE BARREL

[75] Inventor: William A. Knight, Centerville, Iowa

[73] Assignee: Modern Muzzleloading, Inc., Centerville, Iowa

[21] Appl. No.: 444,209

[22] Filed: May 18, 1995

[51] Int. Cl.[6] ..... B05D 91/08

[52] U.S. Cl. ..... 42/75.02; 42/77; 42/51; 42/101; 89/29

[58] Field of Search ..... 42/75.02, 77, 51, 42/101; 89/29

[56] References Cited

U.S. PATENT DOCUMENTS

| | | | |
|---|---|---|---|
| 3,731,418 | 5/1973 | Birkenhagen et al. | 42/77 |
| 4,215,502 | 8/1980 | Loven | 42/61 |
| 4,509,282 | 4/1985 | McMillon | 42/101 |
| 4,519,156 | 5/1985 | Shaw | 42/77 |
| 4,608,909 | 9/1986 | Peters | 89/196 |
| 5,228,887 | 7/1993 | Mayer | 42/75.02 |
| 5,454,182 | 10/1995 | Lewis et al. | 42/51 |
| 5,501,135 | 3/1996 | Beretta | 89/196 |

FOREIGN PATENT DOCUMENTS 319868 4/1935 Italy .

*Primary Examiner*—J. Woodrow Eldred
*Attorney, Agent, or Firm*—Zarley, McKee, Thomte, Voorhees, & Sease

[57] ABSTRACT

A rifle has a conventional gun stock, a receiver mounted thereon immediately rearwardly of an elongated barrel. The receiver has a forward end and a hollow forward end portion to detachably receive the rearward end of the barrel. The barrel has a rearward end portion that is tapered and which is complementary in shape to the tapered interior wall of the hollow forward end portion of the receiver. The receiver and the barrel have matching indicia marks to permit them to be properly aligned when assembled. The rearward end portion of the barrel has a pair of concave shaped wells which are substantially aligned, but partially offset, from threaded apertures in the receiver. Screws having rounded inner ends are mounted within the threaded apertures and penetrate into the wells and forcibly draw the barrel and the receiver into tight engagement with each other.

3 Claims, 2 Drawing Sheets

10
12
14
16
18
20
22
24
26
28
12A
14A
56
58

16
44
52
48
54
48
50
52
14B 44
34
46
42
50
52
32
30
50
46
52
48
36
14B 58
42
46
40
46
38

RIFLE WITH INTERCHANGEABLE BARREL

BACKGROUND OF THE INVENTION

Most rifles do not have the capability of having interchangeable barrels. This is particularly true of muzzleloading rifles. One cannot typically interchange the barrel of a scope mounted rifle for another barrel to create a shotgun or a rifle of different caliber because of the possible movement between the receiver and the barrel. Such movement would make the scope inaccurate.

It is therefore a principal object of the invention to provide a rifle capable of having its barrel interchangeable for barrels of different sizes.

A further object of the invention is to provide a scope mounted rifle capable of having its barrel interchangeable for barrels of different sizes.

A still further object of this invention is to provide a rifle which can easily have its barrel exchanged for a barrel of different size.

A still further object of this invention is to provide a rifle that will not permit movement between the barrel and the receiver when an interchangeable barrel is used.

These and other objects will be apparent to those skilled in the art.

SUMMARY OF THE INVENTION

The rifle of this invention has a conventional gun stock, a receiver mounted thereon immediately rearwardly of an elongated barrel. The receiver has a forward end and a hollow forward end portion to detachably receive the rearward end of the barrel. The barrel has a rearward end portion that is tapered and which is complementary in shape to the tapered interior wall of the hollow forward end portion of the receiver. The receiver and the barrel have matching indicia marks to permit them to be properly aligned when assembled. The rearward end portion of the barrel has a pair of concave shaped wells which are substantially aligned, but partially offset, from threaded apertures in the receiver. Screws having rounded inner ends are mounted within the threaded apertures and penetrate into the wells and forcibly draw the barrel and the receiver into tight engagement with each other.

DESCRIPTION OF THE PREFERRED EMBODIMENT

Figures 1, 2, 3:
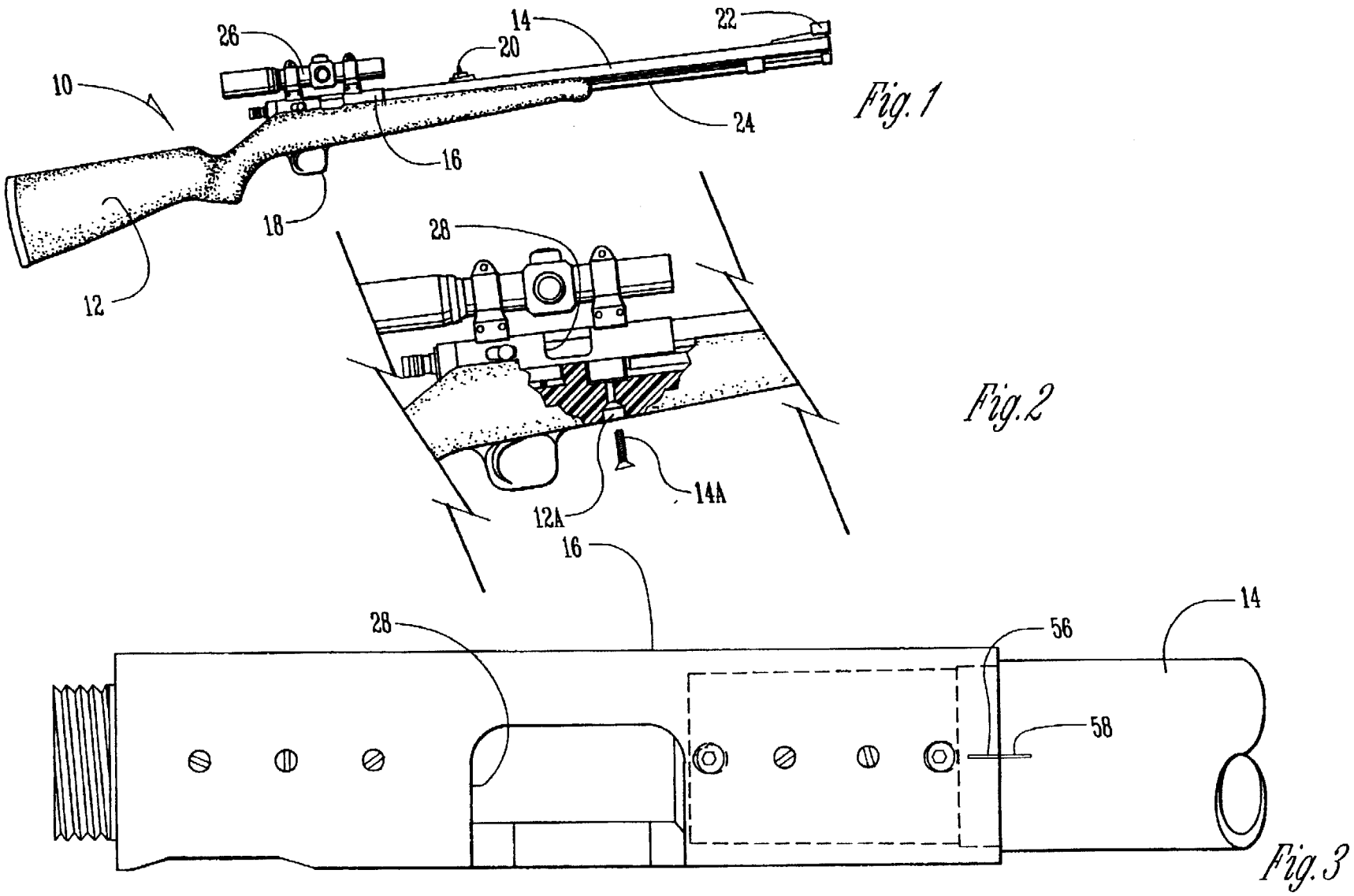
FIG. 1 is a side elevational view of the rifle of this invention.
FIG. 2 is an enlarged scale partial sectional view of the scope, receiver and trigger assembly of FIG. 1.
FIG. 3 is an enlarged scale top plan view of the assembled receiver and barrel.

The muzzleloading rifle 10 has a gun stock 12 with a bottom vertical bore 12A. Bore 12A serves to permit barrel 14 to be secured to the gun stock by means of screw 14A (FIG. 2) which extends through bore 14B (FIG. 5) to secure the barrel to the gun stock. The numeral 16 designates the receiver. Conventional trigger assembly 18, rear site 20, front site 22, ramrod 24, and shooting scope 26 form a part of rifle 10 and are conventional in their function. Receiver 16, as described hereinafter, has special structure to facilitate connecting the receiver and the barrel together.

Receiver 16 has a conventional side opening 28 and a hollow bore 30 with taper side walls 32 adjacent its forward end 34. The side walls 32 taper inwardly from the forward end 34 so that the diameter of the hollow bore 30 progressively decreases. The numeral 36 designates the rearward end of the bore 30.

Figures 4, 5, 6:
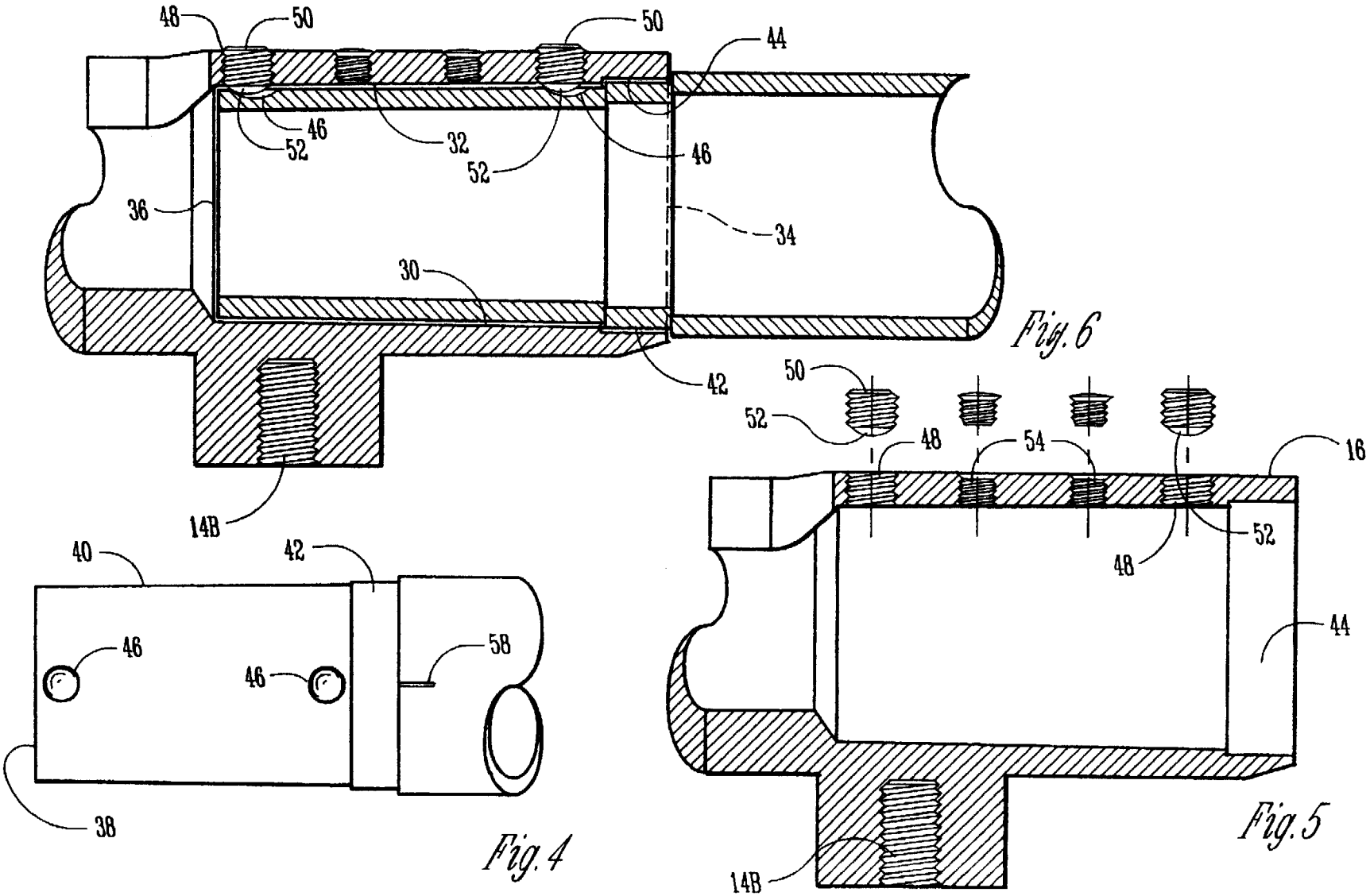
FIG. 4 is an enlarged scale top plan view of the rearward end of the barrel.
FIG. 5 is a partial sectional view of the receiver taken on a vertical plane passing through the central axis of the receiver.
FIG. 6 is a sectional view of the assembled receiver and rifle taken on the same plane as that of FIG. 5.

Barrel 14 has a rearward end 38 (FIG. 4) with a tapered rearward end portion 40. The tapered rearward end portion 40 is complimentary in shape to the tapered side walls 32 of receiver 16. A shoulder 42 (FIG. 4) appears immediately forward of the tapered rearward end portion 40. Shoulder 42 is adapted to be received in the annular groove 44 within the forward end of receiver 16 (FIG. 6). The groove 44 and the shoulder 42 cooperate together to ultimately limit the penetration of the rifle into the receiver.

The tapered rearward end portion 40 of barrel 14 has two wells 46 therein which are concave in shape. Apertures 48 in receiver 16 are substantially vertically aligned with the wells 46 but are slightly offset from the centers of the wells 46 as best shown in FIG. 6. Set screws 50 having rounded concave ends 52 are adapted to be screwed into apertures 48 and penetrate into the wells 46. The slight disalignment of the apertures 48 with respect to the wells 46 permit the set screws 50 to bind against the side edge of the wells to draw the tapered rearward end portion 40 of the barrel into tight engagement with the tapered side walls 32 of the bore 30 in receiver 16.

The numerals 54 designate filler screws for scope 26 when scope 26 is not in place.

When it is desired to change barrels for rifle 10, the screws 50 are loosened and the barrel 14 is longitudinally pulled forwardly out of the receiver 16. A substitute barrel having the same tapered rear end portion 40 of barrel 14 is then inserted into the hollow bore 30 of receiver 16. The indicia mark 56 on receiver 16 is placed in alignment with the indicia mark 58 on barrel 14 as shown in FIG. 3 so that the two components are in proper alignment. The screws 50 are thereupon tightened to penetrate the wells 46 in the manner described above to tightly draw the barrel into the forward end of the receiver. Typically, this will place the tapered rearward end portion 40 of the barrel in tight engagement with the tapered side walls 32 at the forward end of the receiver. Shoulder 42 on the barrel 14 will be in tight engagement with the annular groove 44 at the forward end of the receiver. This arrangement of structure will absolutely prevent any movement of the barrel with respect to the receiver. This can all be accomplished in a rifle that has a scope mounted thereon. Since there is no movement permitted between the receiver and the barrel, the scope will still be effective to perform its intended function and will not be out of adjustment.

Obviously, the substitute barrel can be either a rifle barrel of different caliber, or can be a shotgun barrel. The barrel of rifle 10 can be quickly and easily changed which adds substantial versatility to its use.

From the foregoing, it is seen that this invention will achieve at least all of its stated objectives.

What is claimed is:

1. A rifle having a replaceable barrel, comprising, a gun stock, a receiver on said gun stock, a barrel on said gun stock secured to said receiver, said receiver having an open forward end, and a hollow forward end portion detachably receiving a rearward end portion of said barrel, said open hollow forward end portion of said receiver having an interior diameter that is tapered to have a progressively smaller diameter rearwardly of said open forward end, the rearward end portion of said barrel being tapered and being complimentary in shape to said hollow forward end portion of said receiver, and means detachably securing said rearward end portion of said barrel within said hollow forward end portion of said receiver, said means comprising the rearward end portion of said barrel having at least one concave shaped well, and said hollow forward end portion of said receiver having a threaded bore therein slightly offset and in partial radial disalignment with said concave shaped well, and a set screw in said threaded bore extending into said concave shaped well to forcibly draw said barrel and said receiver into tight engagement with each other.

2. The rifle of claim 1 wherein said rearward end portion of barrel and said hollow forward end portion of said receiver have abutting surfaces to limit the penetration of said barrel into said receiver.

3. The rifle of claim 1 wherein said rearward end portion of said barrel has two concave shaped wells and said hollow end portion of said receiver has two of said threaded bores.

* * * * *